United States Patent [19]

Lee

[11] Patent Number: 5,031,270

[45] Date of Patent: Jul. 16, 1991

[54] FRICTION HINGE

[76] Inventor: Simpson Lee, No. 11, Lane 184, Chung-Hsiao Rd., Pingtung City, Taiwan

[21] Appl. No.: 493,697

[22] Filed: Mar. 15, 1990

[51] Int. Cl.[5] ..... E05F 3/20

[52] U.S. Cl. ..... 16/50; 16/341; 16/342

[58] Field of Search ..... 16/50, 82, 85, 307, 16/337, 341, 308, 342

[56] References Cited

U.S. PATENT DOCUMENTS

| | | | |
|---|---|---|---|
| 754,690 | 3/1904 | Pelzer | 16/50 |
| 926,520 | 6/1909 | Thornton | 16/50 |
| 1,006,765 | 10/1911 | Manderbach | 16/307 |
| 1,632,428 | 6/1927 | Benham et al. . | |
| 1,644,249 | 10/1927 | Harrison . | |
| 1,877,639 | 9/1932 | Banfield | 16/307 |
| 2,516,935 | 8/1950 | Weaver | 16/307 |
| 2,641,794 | 6/1953 | Raskin . | |
| 2,814,049 | 11/1957 | Mercur | 16/307 |
| 3,215,449 | 8/1980 | Loikitz | 16/307 |
| 3,515,433 | 6/1970 | Tabor | 16/342 |
| 3,801,155 | 4/1974 | Hodgen et al. . | |

*Primary Examiner*—Kurt Rowan
*Assistant Examiner*—James Miner
*Attorney, Agent, or Firm*—Harness, Dickey & Pierce

[57] ABSTRACT

A hinge for a self-closing door includes a pair of hinge leaves having their respective knuckles joined to a hinge pin, one of the hinge leaves being fixed to the hinge pin and the other rotatable with respect to the same. A torsion spring is wound when the door to which the hinge is attached is opened. The torsion spring exerts a returning force which tends to keep the door in a closed position. Friction means is employed to arrest the closing of the door to prevent slamming. The friction means includes a first and second set of alternately interleaved friction plates, one set of which rotates while the other remains fixed when the door is allowed to close. The rubbing of the friction plates generates a retarding force which arrests the closing of the door. An adjusting member is also added to vary the amount of friction between the friction plates with the degree of opening of the door.

11 Claims, 6 Drawing Sheets

FRICTION HINGE

BACKGROUND OF THE INVENTION

This invention relates to a door hinge, more particularly to a self-closing door hinge.

Self-closing door hinges are known in the art. Examples of such door hinges are disclosed in U.S. Pat. Nos. 1,644,249 and 2,641,794, the latter introducing a hinge with a helical spring confined in a cylindrical chamber. When attached to a door, a first hinge, which has its helical spring wound in such a direction that the unwinding torque it exerts tends to close the door when the door is open, is attached to the top of the door, and a second hinge, which has a helical spring lighter than the helical spring of the first hinge and wound in a direction reverse to that of the same, is attached to the bottom of the door. The action of the two helical springs prevents the door from slamming when it closes. A main disadvantage of this hinge is that two complementary hinges with two different helical spring arrangements are needed. This makes the particular hinge more expensive and the installation of the hinges more troublesome for the user.

SUMMARY OF THE INVENTION

It is therefore an object of this invention to provide a self-closing door hinge which employs a torsion spring which is wound when the door to which the hinge is attached is opened and exerts an unwinding force which tends to keep the door in a normally closed position, and a friction means to arrest the closing of the door to prevent slamming.

Accordingly, a self-closing door hinge of this invention comprises a pair of hinge leaves having knuckles joined to a hinge pin, one of the hinge leaves being fixed to the hinge pin and the other being rotatable with respect to the hinge pin; a torsion spring which is wound when the door is opened; and friction means for arresting the closing of the door, including alternately interleaved first and second sets of friction plates (similarly employed in U.S. Pat. Nos. 1,623,428 and 3,801,155), the rubbing action of which results in a friction force retarding the closing of the door. The hinge further comprises a ratchet mechanism associated with the rotatable hinge leaf which allows the friction force to be applied only during a closing motion of the door. An adjusting member varies the friction force with the degree of opening of the door.

BRIEF DESCRIPTION OF THE DRAWINGS

Other features and advantages of this invention will become apparent in the following detailed description of the preferred embodiment with reference to the accompanying drawings, in which.

DETAILED DESCRIPTION OF THE PREFERRED EMBODIMENTS

Figure 1:
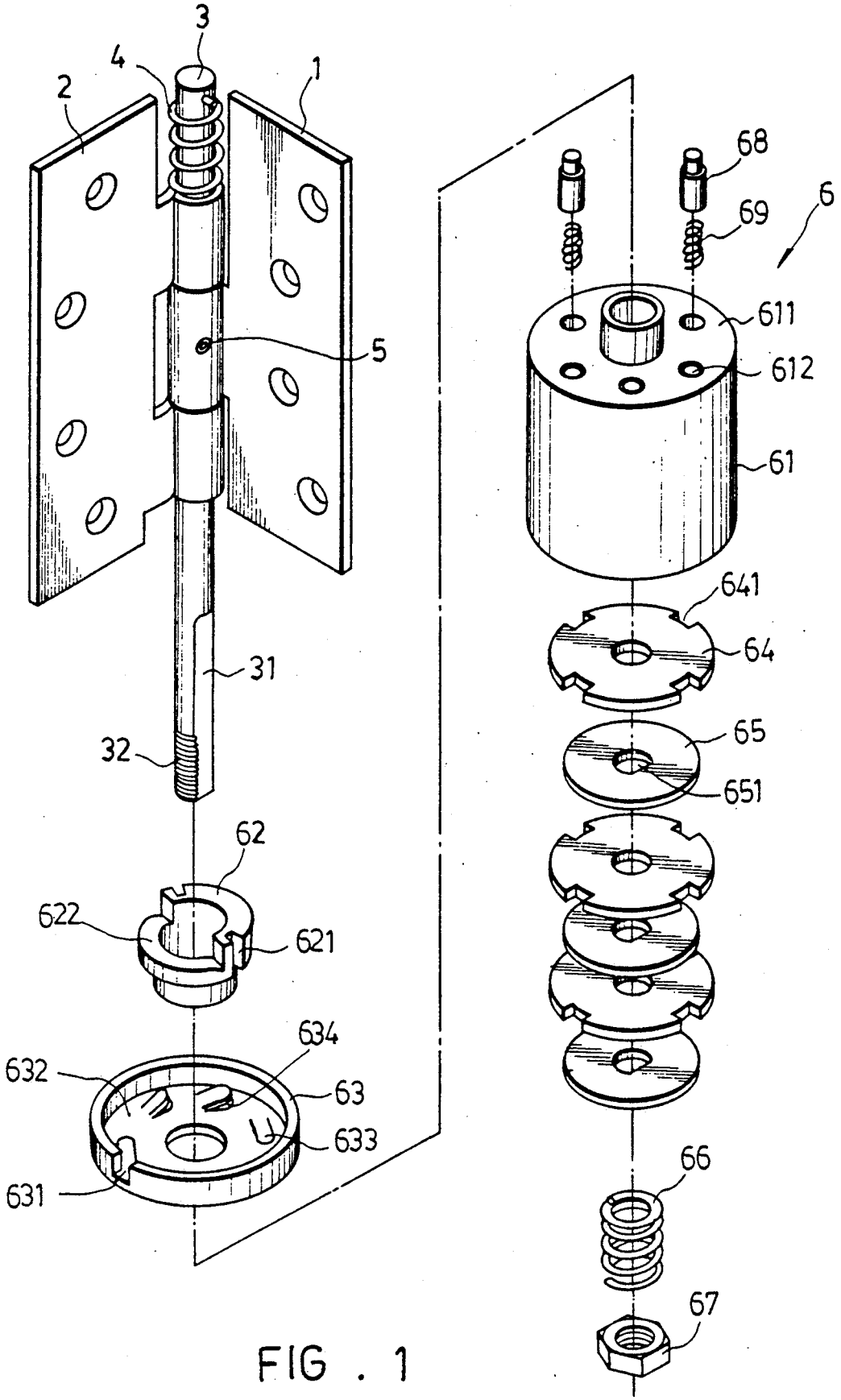
FIG. 1 is an exploded view of a preferred embodiment according to this invention.

FIG. 1 shows an exploded view of a preferred embodiment according to this invention. The hinge comprises a hinge pin 3, a fixed metal hinge leaf 1 and a rotatable metal hinge leaf 2. The two hinge leaves 1, 2, have their knuckles joined together by the hinge pin 3. The fixed hinge leaf 1 is secured to a door frame, while the rotatable hinge leaf 2 is secured to a door. An engaging pin 5 fixes the knuckle of the fixed hinge leaf 1 to the hinge pin 3, preventing the fixed hinge leaf 1 from rotating relative to the hinge pin 3. A torsion spring 4 has one end connected to the hinge pin 3 and another end connected to the rotatable hinge leaf 2. The lower end 31 of the hinge pin 3 is a circular segment in cross section and has external screw threads 32 formed therein. A friction means 6 engaged to the lower end 31 of the hinge pin 3 comprises a cylindrical casing 61, a first set of friction plates 64 and a second set of friction plates 65 alternately and interleavingly arranged, and a helical spring 66. A bolt member 67 with internal screw grooves holds the friction means 6 in place. The second set of friction plates 65 each has a central hole 651 of a size and shape similar to the cross section of the lower end 31. A plurality of spaced bored holes 612 are formed on a top face 611 of the cylindrical casing 61. Each of the bored holes 612 receives a hollow engaging member 68 containing a biasing member 69.

Figure 3:
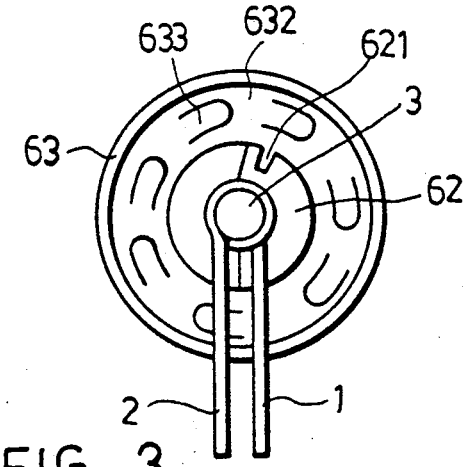
FIG. 3 is a top view of the illustration of FIG. 2A.
Figure 2A:
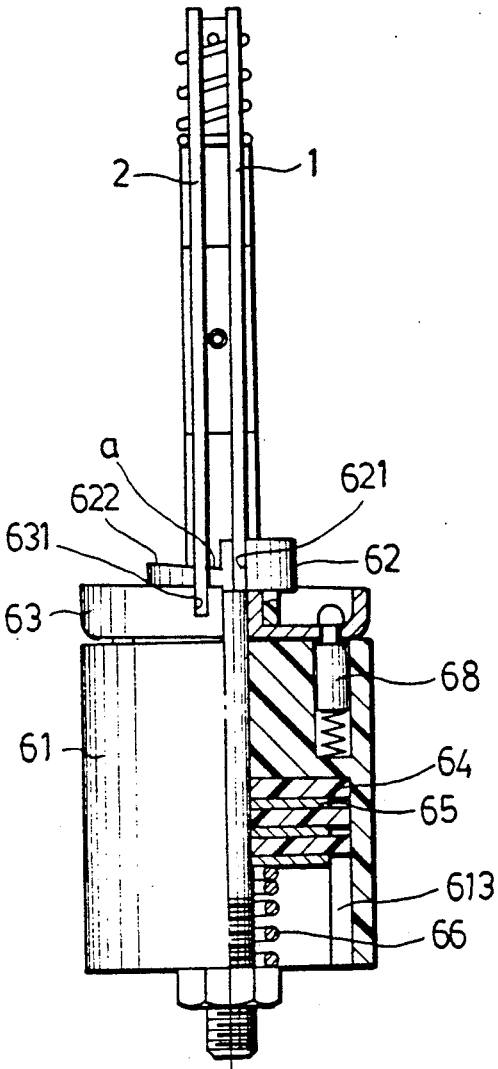
FIGS. 2A, 2B are schematic, partly sectional views of the preferred embodiment of FIG. 1 in use.
Figure 2B:
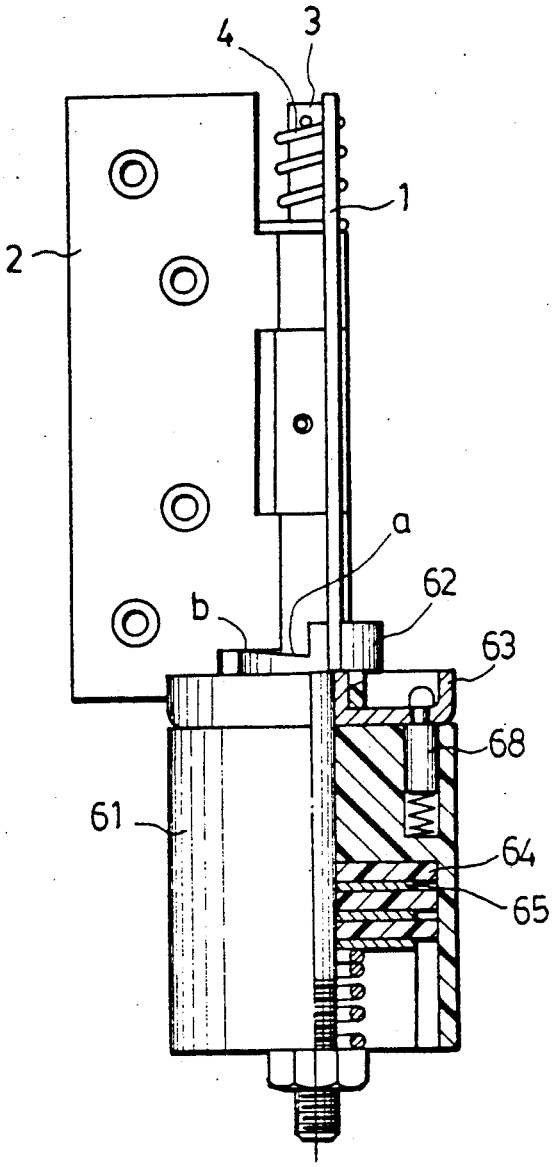

FIGS. 2A, 2B illustrate the preferred embodiment of FIG. 1 in its assembled form. FIG. 2A shows a schematic, partly sectional view of the positioning of the various elements when the door is closed, i.e., the fixed hinge leaf 1 faces the rotatable hinge leaf 2. The lower end of the fixed hinge leaf 1 is received by an axial slot 621 formed on an adjusting member 62. The lower end of the rotatable hinge leaf 2 is received by an axial slit 631 formed on the wall of a ratchet wheel 63. Inside the cylindrical casing 61, the helical spring 66 urges the friction plates 64, 65 towards the top face 611 of the said cylindrical casing 61. FIG. 3 is a top view of the illustration in FIG. 2A.

FIG. 2B shows a schematic, partly sectional view when the door is opened such that the rotatable hinge leaf 2 is rotated 90 degrees clockwise from the fixed hinge leaf 1. The displacement of the rotatable hinge leaf 2 accordingly rotates the ratchet wheel 63. The ratchet wheel 63 further comprises a bottom plate 632 with a plurality of spaced ratchet teeth 633 which project upwards, forming substantially oval openings 634 therein. Whenever the rotatable hinge leaf 2 is rotated in a clockwise direction, no engagement occurs between the ratchet wheel 63 and the cylindrical casing 61. The torsion spring 4, however, urges the rotatable hinge leaf 2 to return to its original position, i.e., brings the door to a closed position.

In this embodiment, there are six bored holes 612 spaced 60 degrees from each other, and seven ratchet teeth 633 spaced approximately 51.5 degrees from each other. When there is no external force exerted to keep the door in an open position, the rotatable hinge leaf 2 will rotate in a counterclockwise direction due to the force applied by the torsion spring 4. A counterclockwise rotation of the rotatable hinge leaf 2 by 8.5 degrees will allow one of the engaging members 68 inside the bored holes 612 to be received by one of the openings 634. The engagement of one of the engaging members 68 with one of the openings 64 will allow the cylindrical casing 61 to correspondingly rotate with the ratchet wheel 63. The cylindrical casing 61 further comprises inwardly projecting axial projections 613. The first set of friction plates 64 each comprises a plurality of peripheral cuts 641 for receiving the axial projections 613. The rotation of the cylindrical casing 61 allows the first set of friction plates 64 to correspondingly rotate. Since the second set of friction plates 65 are not allowed to rotate by the hinge pin 3, the urging action of the helical spring 66 on the friction plates 64, 65 generates a frictional force between the friction plates 64, 65, thus arresting the counterclockwise rotation of the rotatable hinge leaf 2.

As seen in FIGS. 2A, 2B, the adjusting member 62 further comprises a camming surface 622 with a highest point b and two lowest points a. In FIG. 2A, the lower end of the rotatable hinge leaf 2 is initially at one of the lowest points a. In FIG. 2B, the lower end of the rotatable hinge leaf 2 is at the highest point b. The movement of the lower end of the rotatable hinge leaf 2 on the camming surface 622 from one of the lowest points a to the highest point b exerts a downward pushing force on the adjusting member 62, the ratchet wheel 63, and the cylindrical casing 61. The downward pushing force exerted on the cylindrical casing 61 is transmitted to the friction plates 64, 65, urging the friction plates 64, 65 to come into closer contact. The larger the angle of opening between the rotatable hinge leaf 2 and the fixed hinge leaf 1, the greater will be the returning force exerted by the torsion spring 4 on the rotatable hinge leaf 2, and the greater will be the frictional force exerted by the ratchet mechanism 6. The frictional force can thus be seen to vary with the angle of opening.

Referring to FIG. 1, the adjusting member 62 comprises two axial slots 621. This is provided to allow the fixed hinge leaf 1 to be fastened to the door instead of the door frame, and the rotatable hinge leaf 2 to be fastened to the door frame instead of the door.

When the door to which the hinge is to be applied has the door frame embedded in the wall, one may not be able to use the embodiment of FIG. 1, since a recess may have to be provided for on the wall to accommodate a portion of the casing 61. A proposed second embodiment overcomes this problem.

Figure 4:
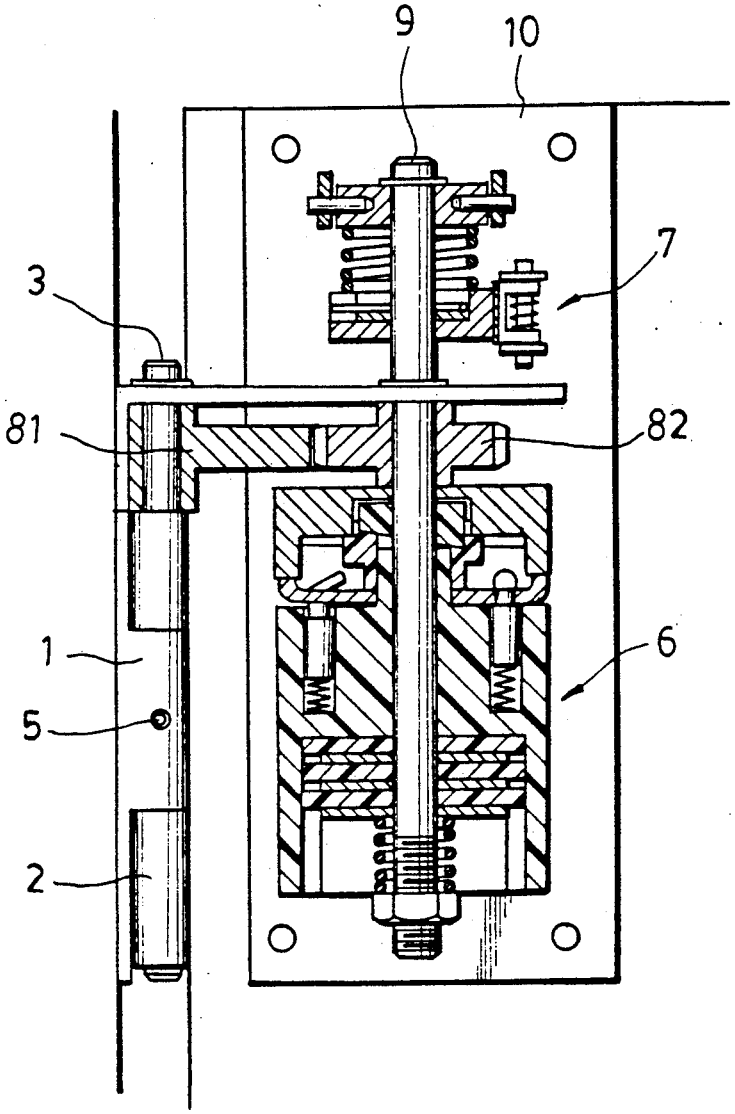
FIG. 4 is a sectional view of a second preferred embodiment according to this invention.

Referring to FIG. 4, a sectional view of a second preferred embodiment is shown. As with the first embodiment, the knuckles of a fixed metal hinge leaf 1 and that of a rotatable metal hinge leaf 2 are joined together by a hinge pin 3. The fixed hinge leaf 1 is fixed to the hinge pin 3 by an engaging pin 5. A first gear 81 is attached to one end of the hinge pin 5 and rotates with the rotatable hinge leaf 2. The first gear 81 rotatably interacts with a second gear 82. The hinge according to this embodiment further comprises a friction means 6, a winding means 7, a center post 9, and a body frame 10.

Figure 5A:
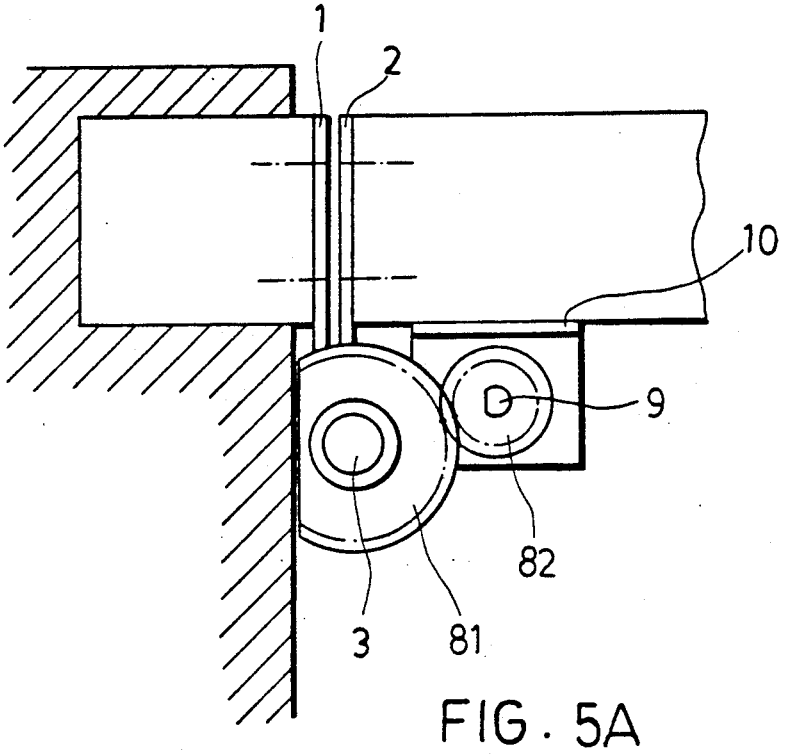
FIGS. 5A, 5B are top views of the preferred embodiment of FIG. 4 in use.
Figure 5B:
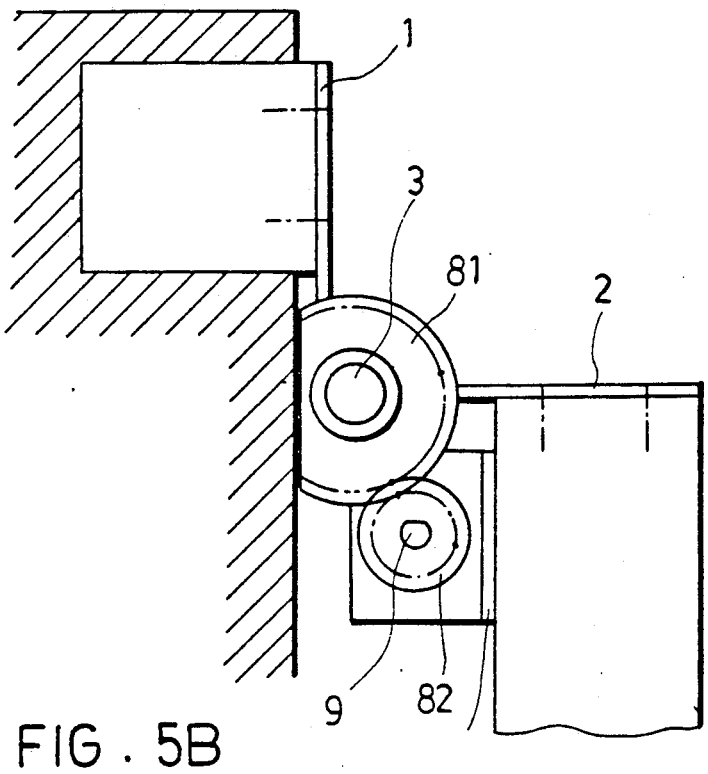

FIGS. 5A, 5B illustrate top views of the second preferred embodiment in use. The fixed hinge leaf 1 is fastened to a door frame while the rotatable hinge leaf 2 is fastened to a door. The rotation of the second gear 82, which has a central hole formed as a circular segment, causes the center post 9, which has a cross section similar to the central hole of the second gear 82, to correspondingly rotate.

Figure 6:
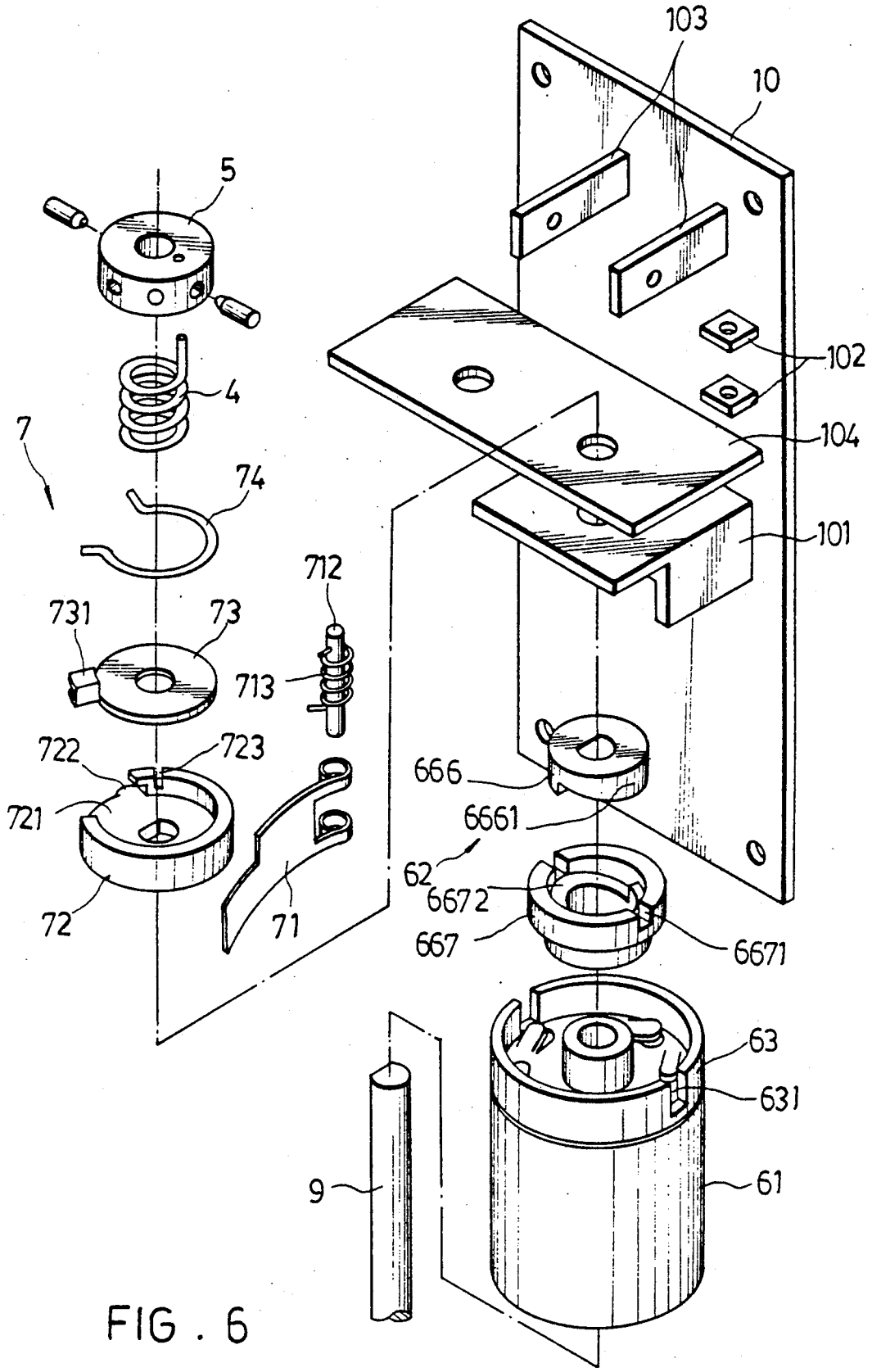
FIG. 6 is an exploded view of the second preferred embodiment.

FIG. 6 shows an exploded view of the second preferred embodiment. An adjusting member 62 further comprises a first ring body 666 and a second ring body 667. The first ring body 666 has a camming surface 6661 while the second ring body 667 has a reciprocating surface 6672 for the camming surface 6661. The first ring body 666 correspondingly rotates with the center post 9. The rotation of the first ring body 666 pushes the second ring body 667 towards a ratchet wheel 63. The friction means 6 is mounted below a horizontally disposed tray support 101 of the body frame 10. As with the first embodiment, a bolt member 67 is threadedly engaged to the lower end of the center post 9 for holding the friction means 6 in place. The ratchet wheel 63 and the second ring body 667 each have axial slits 631, 6671, respectively for receiving a pair of oppositely disposed ⌐-shaped inward protrusions of the tray support 101. Both the ratchet wheel 63 and the second ring body 667 are thus fixed to the body frame 10. The second gear 82 is disposed between the tray support 101 and a horizontal top support 104.

When the door closes, engagement between the ratchet wheel 63 and the casing 61 occurs. The rotation of the center post 9 causes the second set of friction plates 65 to correspondingly rotate, while the first set of friction plates 64 are prevented from rotating with the center post 9 by the engagement of the ratchet wheel 63 with the casing 61.

The winding means 7 is fastened to the upper end of the center post 9. The winding means 7 comprises a fastenable member 71, an actuating wheel 72, a circular insertable member 73 and a substantially C-shaped ring 74. The body frame 10 has two first lugs 102 with a common vertical axis. A rod 712 is axially disposed between the two first lugs 102. A spring member 713 surrounds the rod 712. The spring member 713 has one end connected to the rod 712 and another end connected to the fastenable member 71. The actuating wheel 72 has a circular receiving space 721 for receiving the insertable member 73 and the substantially C-shaped ring 74. The actuating wheel 72 has a hole formed as a circular segment to allow it to correspondingly rotate with the center post 9. The actuating whell 72 further comprises a radial projection 722 on its peripheral edge. The substantially C-shaped ring 74 has two ends bent outwards. One end is received by the actuating wheel 72 and the other end is received by the insertable member 73 for positioning the insertable member 73 relative to the actuating wheel 72.

Figure 7A:
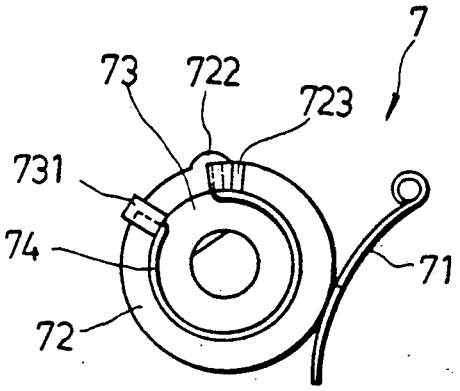
FIGS. 7A, 7B, 7C illustrate the operation of a fastening means of the second preferred embodiment.
Figure 7B:
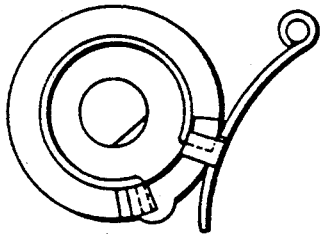
Figure 7C:
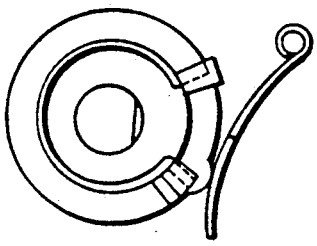

FIGS. 7A, 7B, 7C illustrate the operation of the winding means 7. Initially, when the actuating wheel 72 rotates counterclockwise, the fastenable member 71 fixedly engages with a hook portion 731 of the insertable member 73. Further rotation of the actuating wheel 72 in this direction compresses the C-shaped ring 74, which urges the radial projection 722 to push the fastenable member 71 in order to disengage the insertable member 73. One end of the torsion spring 4 is fixed to a slit 723 formed on the actuating wheel 72. The other end of the torsion spring 4 is attached to a cover 5, which is fixedly mounted between two projecting second lugs 103 of the body frame 10. The counterclockwise rotation of the actuating wheel 72 exerts tension on the torsion spring 4. As with the first embodiment, the force required to close the door is exerted by the torsion spring 4. No engagement between the fastenable member 71 and the insertable member 73 occurs when the actuating wheel 72 rotates in a clockwise direction.

While the present invention has been described in connection with what is considered the most practical and preferred embodiment, it is understood that this invention is not limited to the disclosed embodiments, but is intended to cover various arrangements included within the spirit and scope of the broadest interpretation so as to encompass all such modifications and equivalent arrangements.

I claim:

1. A hinge to be attached to a door, comprising:
a hinge pin;
a first hinge leaf fixed to said hinge pin;
a second hinge leaf being rotatably mounted to said hinge pin;
means for biasing said second hinge leaf towards said first hinge leaf;
friction means for generating a friction force to arrest the relative movement of said second hinge leaf with respect to said first hinge leaf, said friction means including:
a casing having a plurality of spaced bored holes on a top end, a hollow receiving space on a bottom end, and a plurality of inwardly projecting axial projections;
a plurality of biasing members, each biasing member being received by one of said plurality of bored holes of said casing;
a plurality of engaging members, each engaging member having a hollow space for receiving one of said plurality of biasing members;
alternately interleaved first and second sets of friction plates contained inside said hollow space of said casing, said first set of friction plates each having a plurality of peripheral cuts for receiving said plurality of axial projections of said casing whereby said first set of friction plates are stationary with respect to said casing;
means for urging said plurality of friction plates towards said top end of said casing;
a ratchet mechanism associated with said rotatable hinge leaf in such a manner that said ratchet mechanism does not engage with said friction means when said second hinge leaf moves against the biasing force and engages with said friction means when otherwise, whereby friction force is applied to arrest the movement of said second hinge leaf when said second hinge leaf moves with the biasing force.

2. A hinge as claimed in claim 1, wherein said ratchet mechanism comprises a ratchet wheel having a bottom plate with a plurality of spaced ratchet teeth which project upwards, the number of which is one greater than the number of said plurality of spaced bored holes of said casing, said upward projection of said ratchet teeth forming openings on said bottom plate, said bottom plate resting on said top end of said casing;
whereby engagement between one of said plurality of engaging members and said openings only occurs during a motion of said second hinge leaf towards said first hinge leaf.

3. A hinge as claimed in claim 2, wherein said biasing means comprises a torsion spring with one end connected to said hinge pin and another end connected to said rotatable hinge leaf.

4. A hinge as claimed in claim 3, wherein said ratchet mechanism further comprises an adjusting member mounted above said casing, said adjusting member having an axial slot for receiving a lower end of said first hinge leaf; and a camming surface, the movement of the lower end of said second hinge leaf from a lower point to a higher point on said camming surface exerts a downward force on said adjustable member, said downward force being transmitted to said friction plates inside said casing, urging them into closer contact and resulting in a greater friction force.

5. A hinge as claimed in claim 4, wherein the lower end of said hinge pin is a circular segment in cross section, and said second set of friction plates each has a central hole of the same size and shape as the circular segment of said lower end of said hinge pin; said adjusting member, said ratchet wheel, said casing, and said first set of friction plates, each has a central hole formed therein for receiving said hinge pin; whereby said adjusting member, said ratchet wheel, said casing, and said first set of friction plates are capable of rotation when said friction means is mounted to said lower end of said hinge pin.

6. A hinge as claimed in claim 5, further comprising a bolt member threadedly engaged to said lower end of said hinge pin for holding said friction means in place.

7. A hinge as claimed in claim 2, further comprising:
a first gear attached to one end of said hinge pin and rotatable with said second hinge leaf;
a second gear, having a central hole, rotatably interacting with said first gear;
a center post, received by said central hole of said second gear, the rotation of said second gear causing said center post to correspondingly rotate;
winding means for applying tension to said biasing means when said second hinge leaf moves away from said first hinge leaf; and
a body frame for securing said second gear and said winding means.

8. A hinge as claimed in claim 7, wherein said ratchet mechanism further comprises an adjusting member mounted above said casing, said adjusting member having a first ring body and a second ring body; said first ring body, which correspondingly rotates with said center post, having a camming surface; and said second ring body, which is fixed to said body frame, having a reciprocating surface such that the rotation of said first ring body pushes down said second ring body, said pushing force is transmitted to said friction plates inside said casing, urging them into closer contact and resulting in a greater friction force.

9. A hinge as claimed in claim 8, wherein said winding means comprises:
a rod;
a fastenable member adapted to receive said rod;
a spring member surrounding said rod, said spring member having one end connected to said rod and another end connected to said fastenable member;
an actuating wheel having a circular receiving space, a radial projection on its peripheral edge and a slit formed for receiving one end of said biasing means;
a circular insertable member, received by said receiving space of said actuating wheel, having a hook portion for engaging with said fastenable member;
a C-shaped ring, received by said receiving space of said actuating wheel, having two ends bent outwards, one end being received by said actuating wheel and another end being received by said insertable member; and
a cover, fixedly mounted to said body frame, having one end of said biasing means fixed to its frame.

10. A hinge as claimed in claim 9, wherein said center post is a circular segment in cross section, and said second set of friction plates, said first ring body of said adjusting member, and said actuating wheel, each has a central hole of the same size and shape as the cross section of said center post, said second set of friction plates, said first ring body of said adjusting member, and said actuating wheel correspondingly rotate with said central post; and said cover, said insertable member, said second ring body of said adjusting member, said ratchet wheel, said casing, and said first set of friction plates, each has a central hole formed therein for receiving said center post; said cover, said second ring body of said adjusting member, and said ratchet wheel being fixed relative to said body frame.

11. A hinge as claimed in claim 10, further comprising a bolt member threadedly engaged to said lower end of said center post for holding said friction means in place when said friction means is mounted to said lower end of said center post.

* * * * *